US009705219B2

(12) United States Patent
Yamakami et al.

(10) Patent No.: US 9,705,219 B2
(45) Date of Patent: Jul. 11, 2017

(54) CONNECTOR IN WHICH CONTACT IS INSERTED INTO HOLE OF HOUSING TO SEPARATE HOLE INTO MULTIPLE SPACES, AND CONNECTOR UNIT INCLUDING CONNECTOR

(71) Applicant: FUJITSU COMPONENT LIMITED, Tokyo (JP)

(72) Inventors: Tohru Yamakami, Tokyo (JP); Koki Sato, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/886,257

(22) Filed: Oct. 19, 2015

(65) Prior Publication Data

US 2016/0126658 A1 May 5, 2016

(30) Foreign Application Priority Data

Oct. 29, 2014 (JP) ..... 2014-220343

(51) Int. Cl.
*H01R 12/72* (2011.01)
*H01R 12/73* (2011.01)
*H01R 13/6474* (2011.01)

(52) U.S. Cl.
CPC ..... *H01R 12/724* (2013.01); *H01R 12/732* (2013.01); *H01R 13/6474* (2013.01)

(58) Field of Classification Search
CPC .. H01R 23/7073; H01R 23/02; H01R 23/725; H01R 12/732; H01R 12/724; H01R 13/6474
USPC ..... 439/660, 79
See application file for complete search history.

(56) References Cited

U.S. PATENT DOCUMENTS 5,295,843 A * 3/1994 Davis ..... H01R 13/26 439/108
5,356,300 A * 10/1994 Costello ..... H01R 13/631 439/101
5,647,749 A * 7/1997 Atoh ..... H01R 12/725 439/686
6,007,352 A 12/1999 Azuma et al.
6,343,951 B1 * 2/2002 Ono ..... H01R 23/6873 439/108
6,863,549 B2 * 3/2005 Brunker ..... H01R 13/6477 439/108
7,909,652 B2 * 3/2011 Yang ..... H01R 12/714 439/660
7,997,938 B2 * 8/2011 Costello ..... H01R 12/724 439/660
8,342,886 B2 * 1/2013 Zhang ..... H01R 12/7005 439/660
2003/0219999 A1 * 11/2003 Minich ..... H01R 12/727 439/79

(Continued)

FOREIGN PATENT DOCUMENTS

JP H05-073877 U 10/1993
JP H07-033410 U 7/1995

(Continued)

*Primary Examiner* — Harshad Patel
(74) *Attorney, Agent, or Firm* — IPUSA, PLLC

(57) ABSTRACT

A connector includes a housing and a signal plug contact provided in the housing. The housing includes a hole that expands from part of the housing in which the signal plug contact is provided.

3 Claims, 10 Drawing Sheets

(56) References Cited

U.S. PATENT DOCUMENTS

| | | | | |
|---|---|---|---|---|
| 2005/0048846 | A1* | 3/2005 | Suzuki | H01R 24/60<br>439/660 |
| 2006/0141866 | A1* | 6/2006 | Shiu | H01R 13/506<br>439/607.35 |
| 2007/0293084 | A1* | 12/2007 | Ngo | H01R 13/42<br>439/552 |

FOREIGN PATENT DOCUMENTS

| | | |
|---|---|---|
| JP | H10-050410 | 2/1998 |
| JP | 2010-231961 | 10/2010 |

* cited by examiner

CONNECTOR IN WHICH CONTACT IS INSERTED INTO HOLE OF HOUSING TO SEPARATE HOLE INTO MULTIPLE SPACES, AND CONNECTOR UNIT INCLUDING CONNECTOR

CROSS-REFERENCE TO RELATED APPLICATION

The present application is based upon and claims the benefit of priority of Japanese Patent Application No. 2014-220343, filed on Oct. 29, 2014, the entire contents of which are hereby incorporated herein by reference.

BACKGROUND OF THE INVENTION

1. Field of the Invention

The present invention relates to connectors and connector units.

2. Description of the Related Art

Connector units serve as components that connect electronic apparatuses. The connector unit includes a first connector connected to a first electronic apparatus and a second connector connected to a second electronic apparatus. By connecting the first and second connectors, it is possible to transmit electrical signals between the first and second electronic apparatuses.

Reference may be made to Japanese Patent No. 5078168, Japanese Laid-Open Patent Application No. 10-50410, Japanese Examined Utility Model Application Publication No. 7-33410, and Japanese Unexamined Utility Model Application Publication No. 5-73877 for the related art.

SUMMARY OF THE INVENTION

According to an aspect of the present invention, a connector includes a housing and a signal plug contact provided in the housing. The housing includes a hole that expands from part of the housing in which the signal plug contact is provided.

According to an aspect of the present invention, a connector unit includes a first connector and a second connector to be connected to the first connector. The first connector includes a first housing and a signal plug contact provided in the first housing. The first housing includes a first hole that expands from part of the first housing in which the signal plug contact is provided. The second connector includes a second housing and a signal jack contact that comes into contact with the signal plug contact when the second connector is connected to the first connector. The signal jack contact is provided in the second housing. The second housing includes a second hole that expands from part of the second housing in which the signal jack contact is provided.

According to an aspect of the present invention, a connector unit includes a first connector and a second connector. The first connector includes a signal plug contact, and a first power supply jack contact and a second power supply jack contact. Each of the first and second power supply jack contacts has elasticity. The first and second power supply jack contacts are provided in a housing of the first connector so as to exert respective restoring forces in directions to move away from each other. The second connector includes a signal jack contact that comes into contact with the signal plug contact when the second connector is connected to the first connector, and a first power supply plug contact that comes into contact with the first power supply jack contact and a second power supply plug contact that comes into contact with the second power supply jack contact.

DESCRIPTION OF THE EMBODIMENTS

Figure 1:
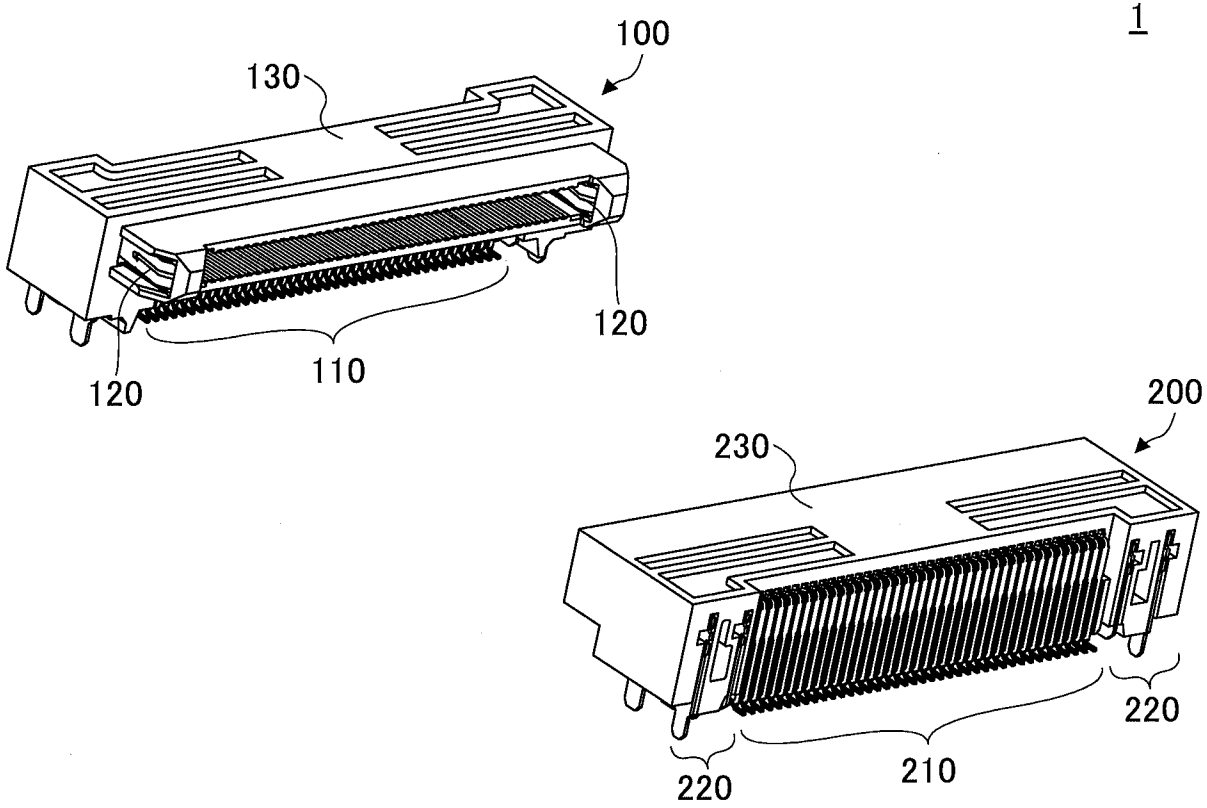
FIG. 1 is a perspective view of a connector unit according to an embodiment.

An embodiment of the present invention is described below, where the same elements are referred to by the same reference numeral and are not repetitively described.

Figure 2:
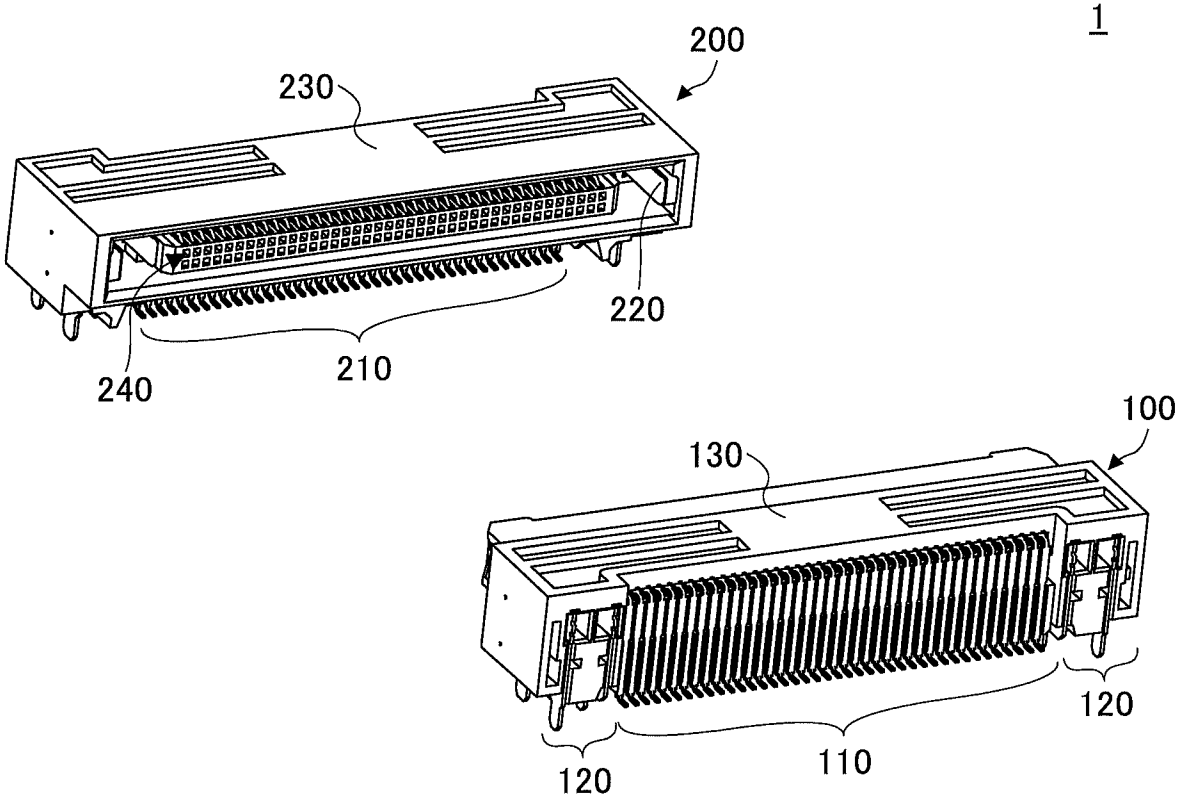
FIG. 2 is a perspective view of the connector unit according to the embodiment.
Figure 3:
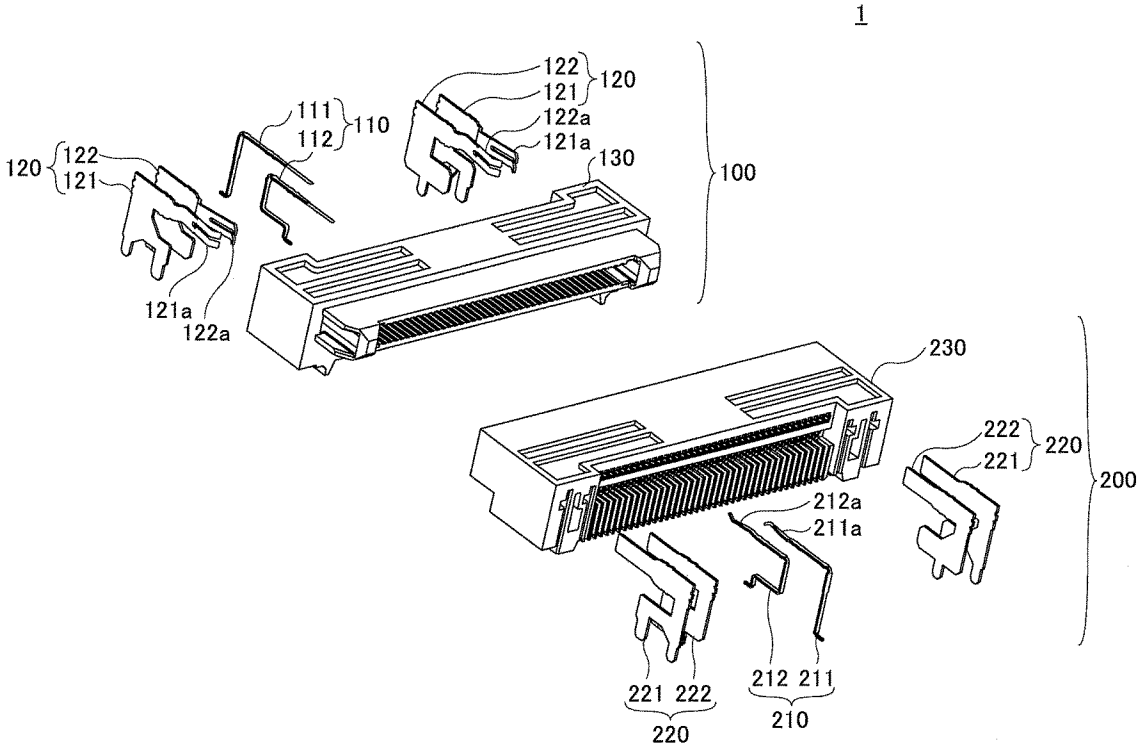
FIG. 3 is an exploded perspective view of the connector unit according to the embodiment.
Figure 4:
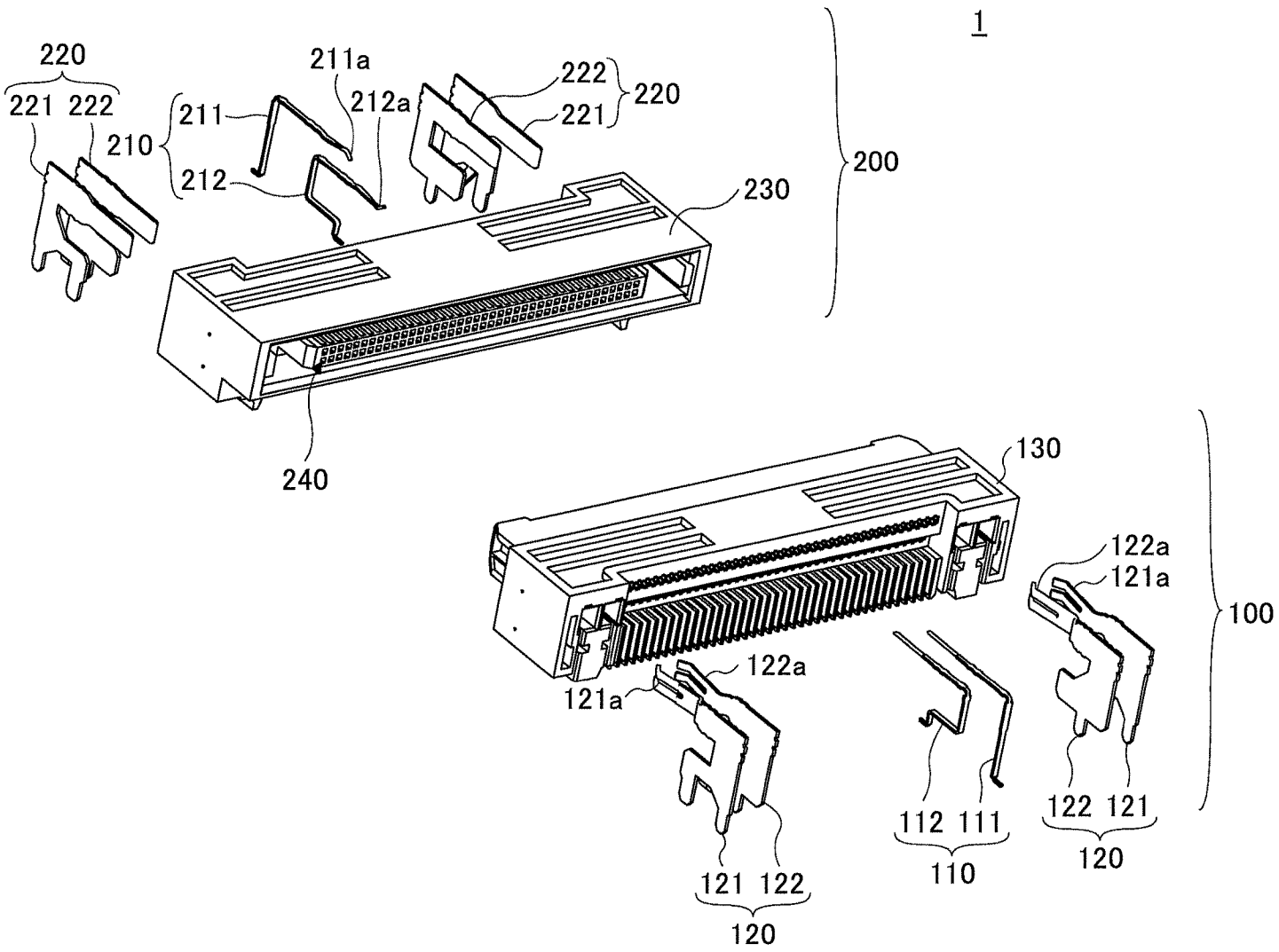
FIG. 4 is an exploded perspective view of the connector unit according to the embodiment.

A connector unit according to this embodiment is described with reference to FIGS. 1 through 4. A connector unit 1 according to this embodiment includes a first connector 100 and a second connector 200 that connects to the first connector 100. FIG. 1 is a perspective view of the connector unit 1, taken from the rear side of the second connector 200. FIG. 2 is a perspective view of the connector unit 1, taken from the rear side of the first connector 100. FIG. 3 is an exploded perspective view of the connector unit 1, taken from the rear side of the second connector 200. FIG. 4 is an exploded perspective view of the connector unit 1, taken from the rear side of the first connector 100.

The first connector 100 includes signal plug contacts 110 and power supply jack contacts 120. The signal plug contacts 110 include first signal plug contacts 111 and second signal plug contacts 112. The power supply jack contacts 120 include first power supply jack contacts 121 and second power supply jack contacts 122.

The first connector 100 includes a housing 130 made of a resin material. The first and second signal plug contacts 111 and 112 and the first and second power supply jack contacts 121 and 122 are provided in the housing 130. In a portion of the housing 130 where the first connector 100 is connected to the second connector 200, the first signal plug contacts 111 are arranged in an upper row, and the second signal plug contacts 112 are arranged in a lower row parallel to a direction in which the first signal plug contacts 111 are arranged.

In this embodiment, one first power supply jack contact 121 and one second power supply jack contact 122 are paired. A pair of the first power supply jack contact 121 and the second power supply jack contact 122 is provided at each transverse end of the housing 130. The first connector 100 according to this embodiment includes two pairs of the power supply jack contacts 121 and 122. According to this embodiment, the first power supply jack contacts 121 are connected to a ground (GND) line, and the second power supply jack contacts 122 are connected to a power supply potential.

The first power supply jack contact 121 and the second power supply jack contact 122 are provided so as to be substantially parallel to each other. The first power supply jack contacts 121 are provided one at each transverse end of the housing 130. The second power supply jack contacts 122 are provided inside the first power supply jack contacts 121, that is, between the first power supply jack contacts 121.

Each first power supply jack contact 121 includes a contact part 121*a* at an end. Each contact part 121*a* is curved outward relative to the first connector 100 in a transverse direction of the first connector 100. Each contact part 121*a* comes into contact with one of first power supply plug contacts 221 provided in the second connector 200. Each contact part 121*a* has a bifurcate end and has a spring property (elasticity). When the first power supply jack contact 121 comes into contact with the first power supply plug contact 221 of the second connector 200, a restoring force due to a spring works in the contact part 121*a* in a direction away from the paired second power supply jack contact 122.

Likewise, each second power supply jack contact 122 includes a contact part 122*a* at an end. Each contact part 122*a* is curved inward relative to the first connector 100 in a transverse direction of the first connector 100. Each contact part 122*a* comes into contact with one of second power supply plug contacts 222 provided in the second connector 200. Each contact part 122*a* has a bifurcate end and has a spring property (elasticity). When the second power supply jack contact 122 comes into contact with the second power supply plug contact 222 of the second connector 200, a restoring force due to a spring works in the contact part 122*a* in a direction away from the paired first power supply jack contact 121.

That is, the first power supply jack contacts 121 and the second power supply jack contacts 122 are provided so that a restoring force due to a spring works in a direction to move the first and second power supply jack contacts 121 and 122 away from each other when the first connector 100 is connected to the second connector 200, and each of the contact parts 121*a* and 122*a* protrudes in a direction away from the second power supply jack contact 122 and the first power supply jack contact 121, respectively.

The second connector 200 includes signal jack contacts 210 and power supply plug contacts 220. The signal jack contacts 210 include first signal jack contacts 211 and second signal jack contacts 212. The power supply plug contacts 220 include the first power supply plug contacts 221 and the second power supply plug contacts 222.

The second connector 200 includes a housing 230 made of a resin material. The first and second signal jack contacts 211 and 212 and the first and second power supply plug contacts 221 and 222 are provided in the housing 230. In a portion of the housing 230 in which the second connector 200 is connected to the first connector 100, the first signal jack contacts 211 are arranged in an upper row, and the second signal jack contacts 212 are arranged in a lower row parallel to a direction in which the first signal jack contacts 211 are arranged. Multiple openings 240 are provided in the connecting portion of the second connector 200, and the first and second signal jack contacts 211 and 212 are provided behind the openings 240.

In this embodiment, one first power supply plug contact 221 and one second power supply plug contact 222 are paired. A pair of the first power supply plug contact 221 and the second power supply plug contact 222 is provided at each transverse end of the housing 230. The second connector 200 according to this embodiment has two pairs of power supply plug contacts 221 and 222. According to this embodiment, the first power supply plug contacts 221 are connected to a ground line, and the second power supply plug contacts 222 are connected to a power supply potential.

The first power supply plug contacts 221 and the second power supply plug contacts 222 are provided so as to be substantially parallel to each other. The first power supply plug contacts 221 are provided one at each transverse end of the housing 230. The second power supply plug contacts 222 are provided inside the first power supply plug contacts 221, that is, between the first power supply plug contacts 221.

The first power supply plug contacts 221 are longer than the second power supply plug contacts 222 in a direction to connect to the first connector 100. Therefore, when the first connector 100 and the second connector 200 connect, the first power supply plug contacts 221 and the first power supply jack contacts 121 first come into contact, and then the second power supply plug contacts 222 and the second power supply jack contacts 122 come into contact with the first power supply plug contacts 221 and the first power supply jack contacts 121 being kept in contact.

Each of the first power supply plug contacts 221 and the second power supply plug contacts 222 has a plate-shaped end. The first power supply plug contacts 221 and the second power supply plug contacts 222 exert a lower spring force than the first power supply jack contacts 121 and the second power supply jack contacts 122.

According to this embodiment, of the contacts that come into contact with each other when the first connector 100 and the second connector 200 are connected, those having more elasticity are referred to as "jack contacts" and those having less elasticity are referred to as "plug contacts." That is, jack contacts are more elastic than plug contacts. Accordingly, when a plug contact and a jack contact come into contact, the jack contact is pressed by the plug contact so as to deform while being in contact with the plug contact, so that a restoring force toward the plug contact is generated by the elasticity of the jack contact. As a result, the plug contact is pressed by the restoring force of the jack contact, so that the jack contact and the plug contact are kept in contact.

According to this embodiment, contact parts 211*a* of the first signal jack contacts 211 and contact parts 212*a* of the second signal jack contacts 212 have more elasticity than the first and second signal plug contacts 111 and 112. Likewise, the contact parts 121*a* of the first power supply jack contacts 121 and the contact parts 122*a* of the second power supply jack contacts 122 have more elasticity than the first and second power supply plug contacts 221 and 222.

Regarding the power supply contacts, the more elastic first and second power supply jack contacts 121 and 122 are provided in the first connector 100, and the less elastic first and second power supply plug contacts 221 and 222 are provided in the second connector 200.

Figure 5:
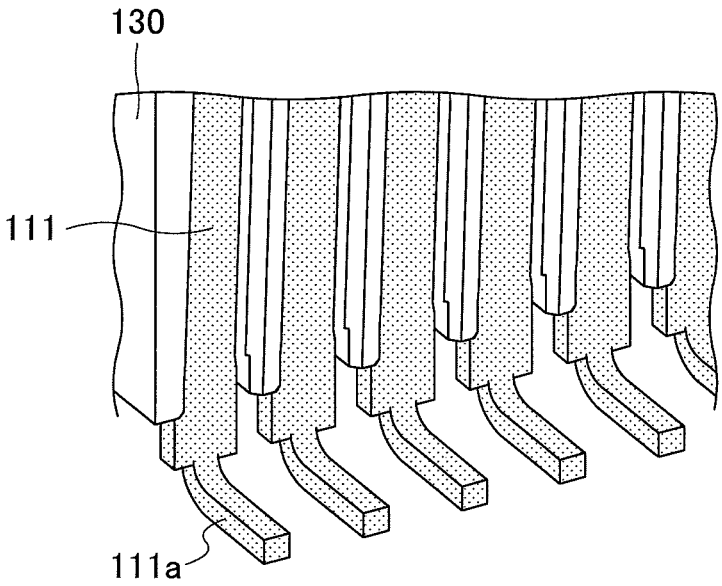
FIG. 5 is a perspective view of lead parts of signal plug contacts and signal jack contacts.
Figure 6:
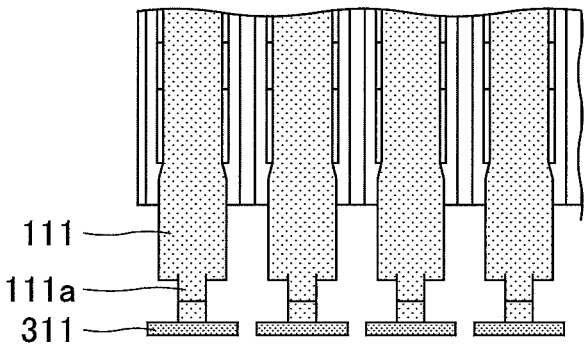
FIG. 6 is a front view of lead parts of the signal plug contacts and the signal jack contacts.

Referring to FIGS. 5 and 6, a lead part 111*a* of each of the first signal plug contacts 111 is formed by cutting and bending so as to reduce the length of an area of an impedance mismatch when the lead parts 111*a* are connected by soldering or the like to electrode pads 311 provided on, for example, a printed board on which the first connector 100 is mounted. According to this embodiment, like the lead parts 111*a* of the first signal plug contacts 111, a lead part of each of the second signal plug contacts 112, the first signal jack contacts 211, and the second signal jack contacts 212 also is formed by cutting and bending.

Figure 7:
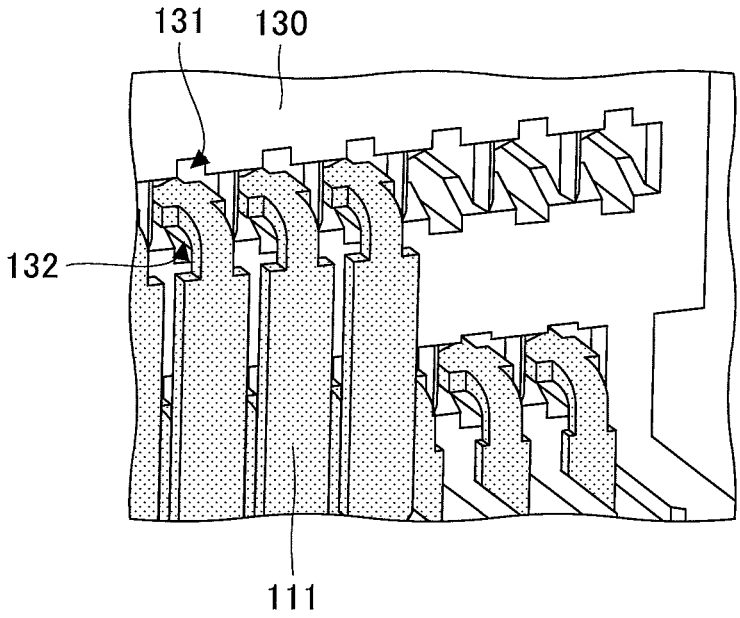
FIG. 7 is a diagram illustrating holes in a housing.
Figure 8:
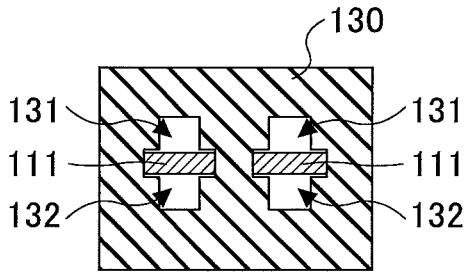
FIG. 8 is a diagram illustrating the holes in the housing.

Referring to FIGS. 3 and 4, the first signal plug contacts 111 and the second signal plug contacts 112 are provided in the housing 130 with their respective ends being inserted in the housing 130. Furthermore, referring to FIGS. 7 and 8, in part of the housing 130 in which the first and second signal plug contacts 111 and 112 are inserted, a hole 131 is provided on top of each of the first signal plug contacts 111 and a hole 132 is provided under the first signal plug contact 111. That is, the hole 131 and the hole 132 are vertically across each of the first signal plug contacts 111 from each other.

As an example, portions of the first and second signal plug contacts 111 and 112 that are inserted in the housing 130 have a flat plate shape of 0.2 mm in thickness and 0.5 mm in width. In the housing 130, the holes 131 are formed at positions that face first surfaces (upper surfaces in FIG. 8) of the flat plate portions of the first and second signal plug contacts 111 and 112, and the holes 132 are formed at positions that face second surfaces (lower surfaces in FIG. 8) of the flat plate portions of the first and second signal plug contacts 111 and 112. By way of example, the holes 131 and 132 are 0.3 mm square holes. By thus providing the housing 130 with the holes 131 and 132, it is possible to adjust impedance.

The impedance differs depending on the shapes of the first and second signal plug contacts 111 and 112. Therefore, it is possible to shape the first and second signal plug contacts 111 and 112 so as to achieve a desired impedance value. In this case, however, the strength of the first and second signal plug contacts 111 and 112 may be reduced depending on their shapes.

On the other hand, according to this embodiment, the first and second signal plug contacts 111 and 112 are so shaped as to maintain their strength, and the impedance is adjusted by forming the holes 131 and 132 in the housing 130 and by adjusting the size of the holes 131 and 132. The relative permittivity of the resin material forming the housing 130 is approximately 4, while the relative permittivity of air that has entered the holes 131 and 132 is approximately 1. Therefore, the impedance may be increased by increasing the size of the holes 131 and 132.

Figure 10:
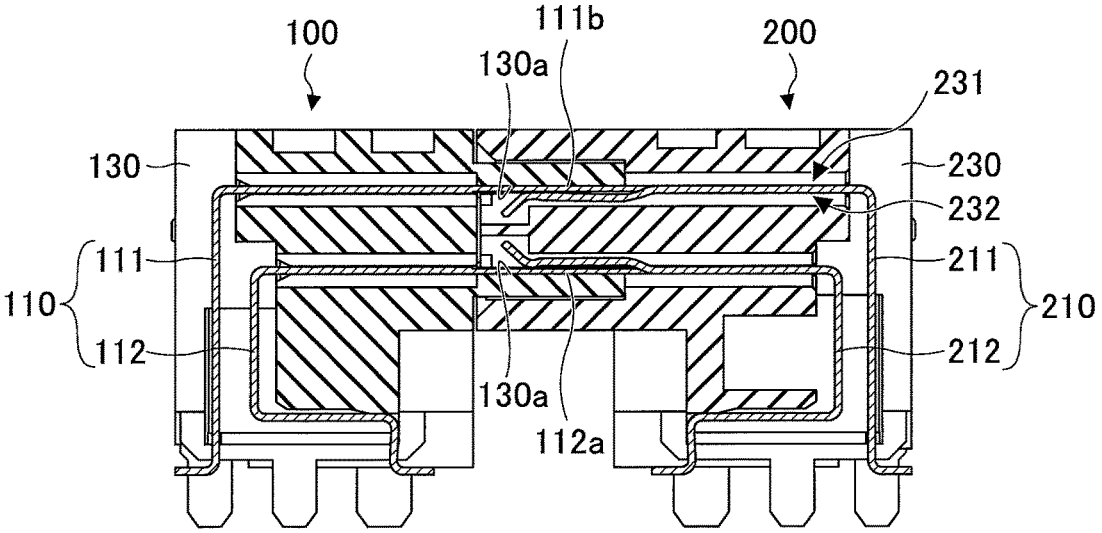
FIG. 10 is a cross-sectional view of the connector unit according to the embodiment.

According to this embodiment, as illustrated in FIG. 10, holes 231 and holes 232 like the holes 131 and 132 are provided in part of the housing 230 of the second connector 200 where the first and second signal jack contacts 211 and 212 are provided. By thus providing the holes 231 and 232 on top of and under the first signal jack contacts 211 in part of the housing 230 where the first and second signal jack contacts 211 and 212 are provided, it is possible to adjust impedance.

Figure 9:
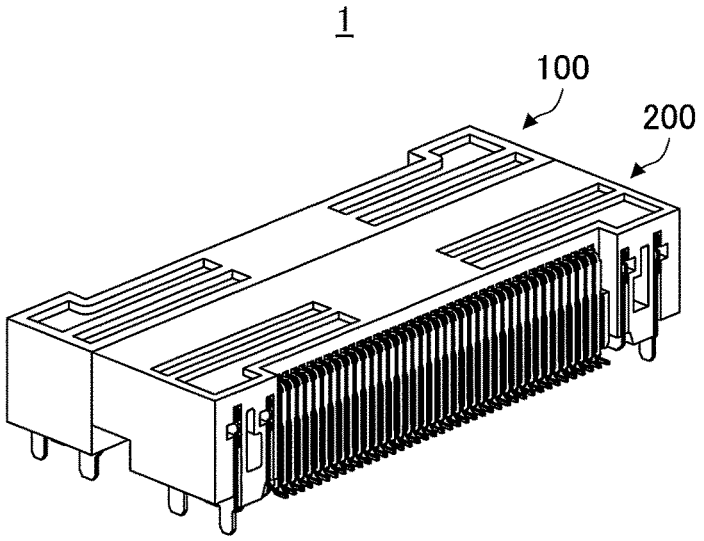
FIG. 9 is a perspective view of the connector unit according to the embodiment.
Figure 11:
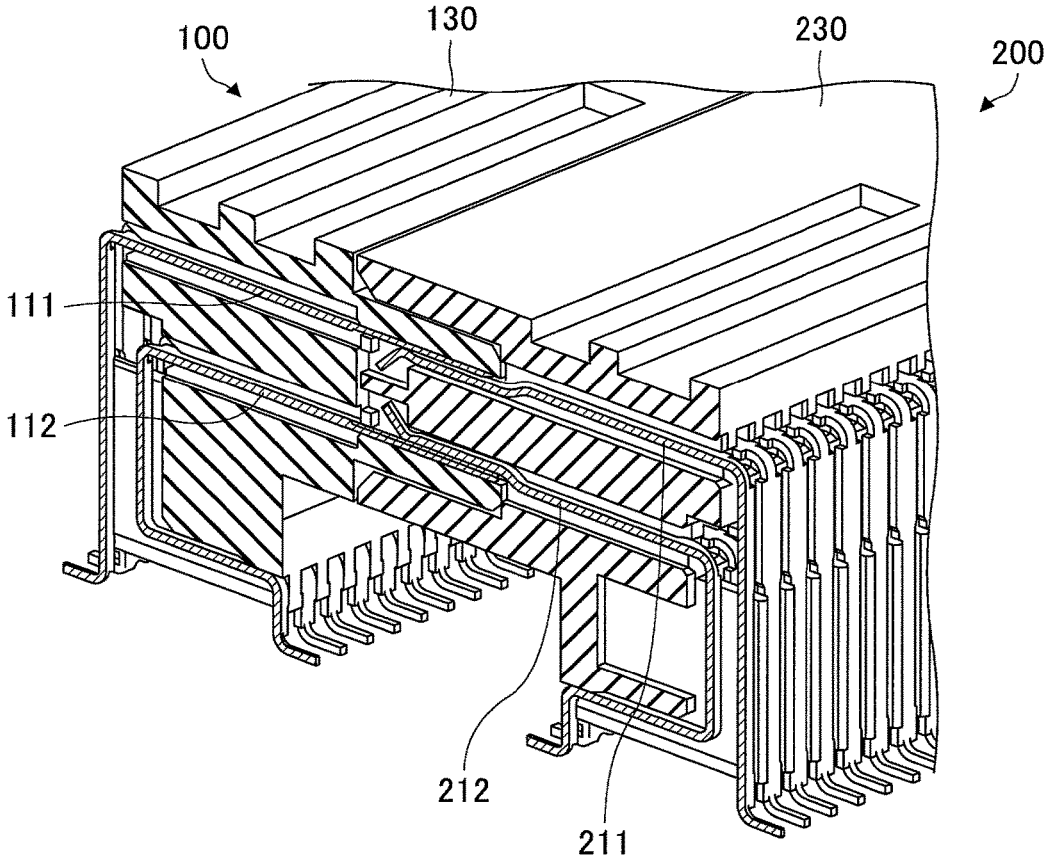
FIG. 11 is a perspective cross-sectional view of the connector unit according to the embodiment.
Figure 12:
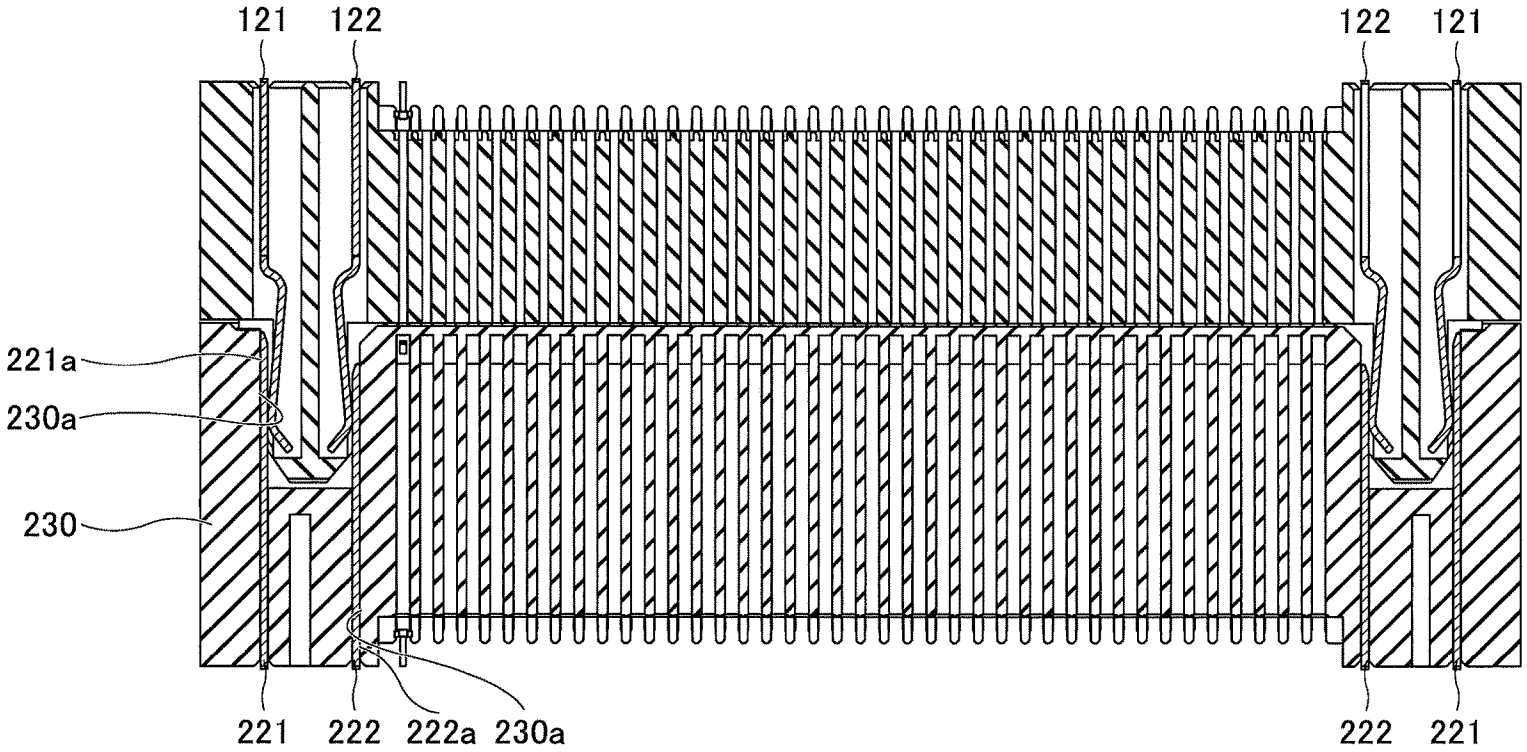
FIG. 12 is a cross-sectional view of the connector unit according to the embodiment.
Figure 13:
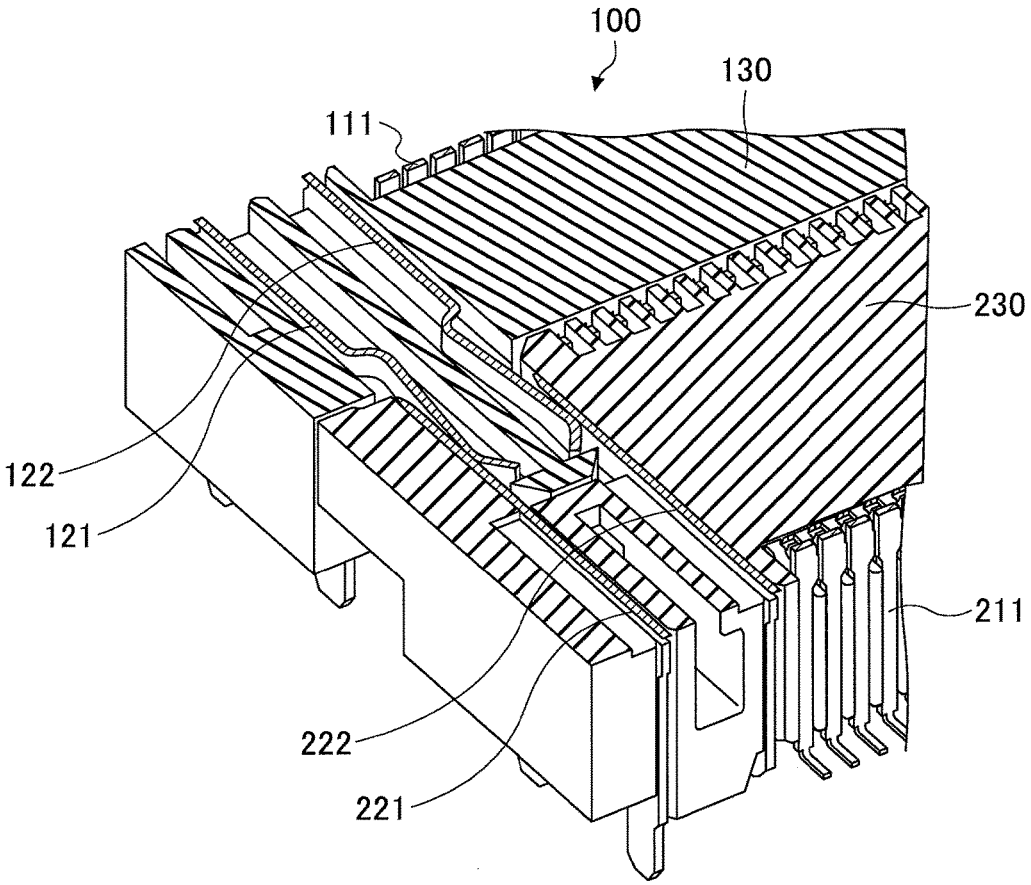
FIG. 13 is a perspective cross-sectional view of the connector unit according to the embodiment.

Next, the connector unit 1 according to this embodiment in which the first connector 100 and the second connector 200 are connected is described with reference to FIG. 9 through FIG. 13. FIG. 9 is a perspective view of the connector unit 1 where the first connector 100 and the second connector 200 are connected. FIG. 10 and FIG. 11 are a cross-sectional view and a perspective cross-sectional view, respectively, of the connector unit 1, taken along a plane that sections part of the connector unit 1 where signal plug contacts 110 and signal jack contacts 210 are in contact. FIG. 12 and FIG. 13 are a cross-sectional view and a perspective cross-sectional view, respectively, of the connector unit 1, taken along a plane that sections part of the connector unit 1 where the power supply jack contacts 120 and the power supply plug contacts 220 are in contact.

When the first connector 100 and the second connector 200 are connected, the first signal plug contacts 111 and the first signal jack contacts 211 come into contact, and the second signal plug contacts 112 and the second signal jack contacts 212 come into contact as illustrated in FIGS. 10 and 11.

When the first signal jack contacts 211 and the first signal plug contacts 111 contact each other, the first signal jack contacts 211 are positioned under the first signal plug contacts 111, and upper surfaces 111*b* of the first signal plug contacts 111 are in contact with an interior wall surface 130*a* of the housing 130. Therefore, each of the first signal jack contact 211 is pressed by the corresponding first signal plug contact 111 so as to be displaced downward. The first signal jack contacts 211, however, have a spring property. Therefore, the pressed first signal jack contacts 211 are urged upward by spring restoring forces, so that the first signal plug contacts 111 and the first signal jack contacts 211 are kept in contact.

Likewise, as illustrated in FIGS. 10 and 11, the second signal jack contacts 212 are positioned on top of the second signal plug contacts 112, and lower surfaces 112*a* of the second signal plug contacts 112 are in contact with the interior wall surface 130*a* of the housing 130. Therefore, the second signal jack contacts 212 are pressed by the second signal plug contacts 112 so as to be displaced upward. The second signal jack contacts 212, however, have a spring property. Therefore, the pressed second signal jack contacts 212 are urged downward by spring restoring forces, so that the second signal plug contacts 112 and the second signal jack contacts 212 are kept in contact.

Furthermore, when the first connector 100 is connected to the second connector 200, the first power supply jack contacts 121 and the first power supply plug contacts 221 come into contact, and the second power supply jack contacts 122 and the second power supply plug contacts 222 come into contact as illustrated in FIGS. 12 and 13.

When the first power supply jack contacts 121 and the first power supply plug contacts 221 contact each other, each of the first power supply jack contacts 121 is positioned inside the corresponding first power supply plug contact 221, and an outer surface 221*a* of each first power supply plug contact 221 is in contact with an interior wall surface 230*a* of the housing 230. Therefore, the first power supply jack contacts 121 are pressed by the first power supply plug contacts 221 to be displaced inward. The first power supply jack contacts 121, however, have a spring property. Therefore, the first power supply jack contacts 121 are urged outward by spring restoring forces, so that the first power supply plug contacts 221 and the first power supply jack contacts 121 are kept in contact.

Likewise, each of the second power supply jack contact 122 is positioned outside the corresponding second power supply plug contact 222, and an inner surface 222*a* of each second power supply plug contact 222 is in contact with the interior wall surface 230*a* of the housing 230. Therefore, the second power supply jack contacts 122 are pressed by the second power supply plug contacts 222 to be displaced outward. The second power supply jack contacts 122, however, have a spring property. Therefore, the second power supply jack contacts 122 are urged inward by spring restoring forces, so that the second power supply plug contacts 222 and the second power supply jack contacts 122 are kept in contact.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A connector unit, comprising:

a first connector; and a second connector connectable to the first connector, wherein the first connector includes a signal plug contact; and a first pair of a first power supply jack contact and a second power supply jack contact, each of the first and second power supply jack contacts having elasticity, the first power supply jack contact and the second power supply jack contact being provided in a housing of the first connector so as to exert respective restoring forces in directions to move away from each other, the first power supply jack contact and the second power supply jack contact being arranged in a transverse direction of the housing, wherein the first power supply jack contact is configured to exert the restoring force in the direction to move away from the second power supply jack contact, and the second power supply jack contact is configured to exert the restoring force in the direction to move away from the first power supply jack contact to move toward the signal plug contact, and the second connector includes a signal jack contact that comes into contact with the signal plug contact when the second connector is connected to the first connector; and a first power supply plug contact that comes into contact with the first power supply jack contact, and a second power supply plug contact that comes into contact with the second power supply jack contact.

2. The connector unit as claimed in claim 1, wherein the signal plug contact includes a plurality of signal plug contacts that are arranged in the transverse direction of the housing.

3. The connector unit as claimed in claim 1, wherein the first connector further includes a second pair of the first power supply jack contact and the second power supply jack contact, the first pair of the first power supply jack contact and the second power supply jack contact is provided at a first transverse end of the housing and the second pair of the first power supply jack contact and the second power supply jack contact is provided at a second transverse end of the housing opposite to the first transverse end, and the signal plug contact is positioned between the first pair and the second pair of the first power supply jack contacts and the second power supply jack contacts.

* * * * *